US008387606B1

(12) United States Patent
Yurechko

(10) Patent No.: US 8,387,606 B1
(45) Date of Patent: Mar. 5, 2013

(54) AIR RIFLE PELLET LOADER

(76) Inventor: Jeffrey Yurechko, Mt. Pleasant, PA (US)

( * ) Notice: Subject to any disclaimer, the term of this patent is extended or adjusted under 35 U.S.C. 154(b) by 539 days.

(21) Appl. No.: 12/454,057

(22) Filed: May 12, 2009

(51) Int. Cl.
*F41A 9/10* (2006.01)

(52) U.S. Cl. ..... 124/45

(58) Field of Classification Search ..... 124/45; 221/268, 270
See application file for complete search history.

(56) References Cited

U.S. PATENT DOCUMENTS 4,831,998 A * 5/1989 Maguire, III ..... 124/50
2009/0301456 A1* 12/2009 Barwick, Jr. ..... 124/45

* cited by examiner

*Primary Examiner* — Alvin Hunter
*Assistant Examiner* — Amir Klayman
(74) *Attorney, Agent, or Firm* — Richard K Thomson

(57) ABSTRACT

A hand-held device for storing and loading pellets in an air rifle includes a pair of sawtooth members, a second member overlying the first. The second sawtooth member is mounted for axial movement in a U-shaped housing, while the first sawtooth member is mounted for vertical movement in the housing, with a pair of springs biasing it into engagement with the second member. A cam plate pushes the first member downwardly to accommodate the movement of pellets from a first storage chamber to a second chamber positioned seriatim. A loader extends from the back of the loader to the front, ejecting a pellet into the firing chamber of an air rifle and flaring the skirt to make the exit velocity consistent for improved marksmanship.

10 Claims, 3 Drawing Sheets

AIR RIFLE PELLET LOADER

BACKGROUND AND SUMMARY OF THE INVENTION

The present invention is directed to the field of riflery. More particularly the present invention is directed to a pellet storage device and loader for an air rifle.

Manipulating pellets to orient them properly and install them into the chamber of an air rifle, given their relatively small size, is a task for smaller fingers than most riflemen have. The task is complicated by having to perform it in the field in various weather and lighting conditions. It is an object of the present invention to provide a pellet loader that can be pre-filled with one or more pellets. The loader will then advance the supply of pellets seriatim from one storage compartment to another without damaging the exterior of the pellet, to a loading chamber where the rifleman uses a transversely extending loader in the form of an ejection rod which pushes the pellet into the firing chamber of the rifle. The end of the ejection rod has a spherically shaped member that engages inside the tail end of the pellet and, as the loader seats the pellet against the forward end of the chamber, the spherically shaped member expands the skirt of the pellet to provide superior engagement with the sidewalls making the muzzle velocity more consistent.

The pellet loader of the present invention is a device for loading pellets in an air rifle, the device comprising: a) a series of storage chambers aligned seriatim, each storage chamber capable of receiving a pellet, said series of storage chambers including a proximal storage chamber and a distal storage chamber; b) advancing means for moving the pellet from one storage chamber in the series of chambers to an adjacent one in the series of storage chambers; c) a loading chamber at a distal end of the series of storage chambers for receiving the pellet from the distal storage chamber; d) a loader for engaging the pellet in the loading chamber and transferring it laterally into an exit chamber where the pellet can be loaded into the air rifle. The series of storage chambers is defined by a first saw-tooth bar and a second saw-tooth bar positioned adjacent the first saw-tooth bar. The first saw-tooth bar is interconnected to the second saw-tooth bar by a first and a second side plate.

Mounting means between the first and second side plate and the first and second saw-tooth bars permits the first and second saw-tooth members to laterally displace one from another while the first and second saw-tooth members translate longitudinally relative to each other. The advancing means is comprised of the second saw-tooth bar translating relative to the first saw-tooth member carrying at least one pellet from a first storage chamber to an adjacent storage chamber. The first and second side plates are arms of a U-shaped housing surrounding the first and second sawtooth members, and spring means is positioned in a bottom portion of the U-shaped housing engaging a lower side of the first sawtooth member and biasing it upwardly into engagement with the second sawtooth member. Cam means causes first and second sawtooth members to separate as the second sawtooth member translates relative to the first sawtooth member to permit passage of the at least one pellet. The cam means engages a laterally extending cam follower positioned in a vertically extending slot, the cam follower being attached to the first sawtooth member, whereby engagement of the cam follower by the cam means forces the first sawtooth member downwardly against the spring means away from the second sawtooth member.

An O-ring is positioned at a juncture between the loading chamber and the exit chamber, the O-ring having an internal dimension smaller than a maximum external dimension of the pellet, retarding an egress of the pellet through the O-ring. The loader comprises an ejection rod having an engagement end with a spherical portion, the spherical portion engaging within an open end of the pellet and broadening a skirt formed on the open end as the engagement end pushes the pellet into a breach portion of an air rifle.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
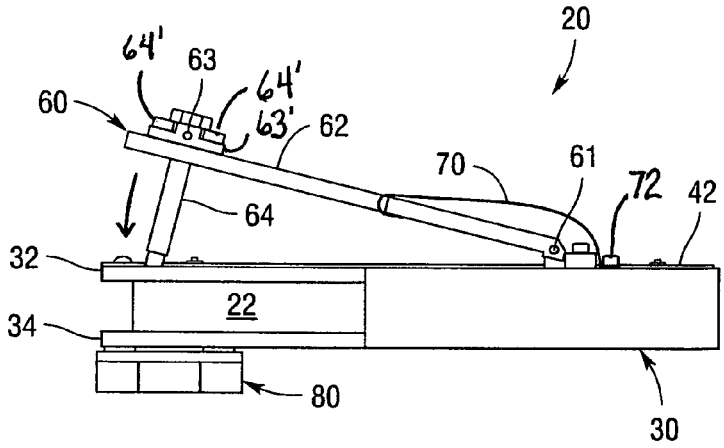
FIG. 1 is a top view of a first embodiment of the pellet loader of the present invention.
Figure 2:
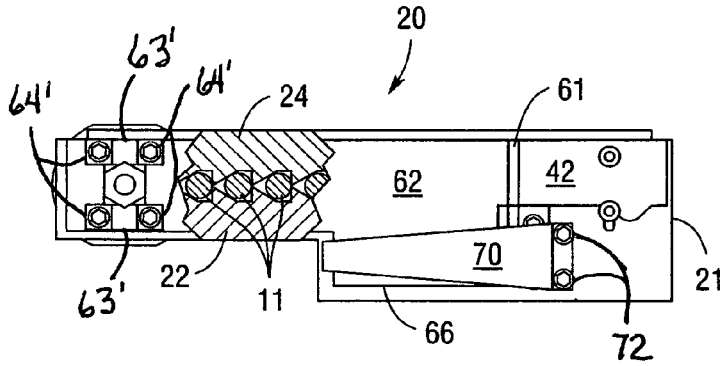
FIG. 2 is a back side view of the first embodiment in partial section.
Figure 3:
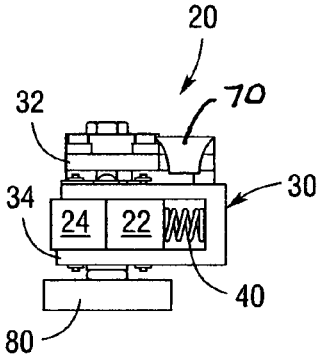
FIG. 3 is an end view of the first embodiment.
Figure 4:
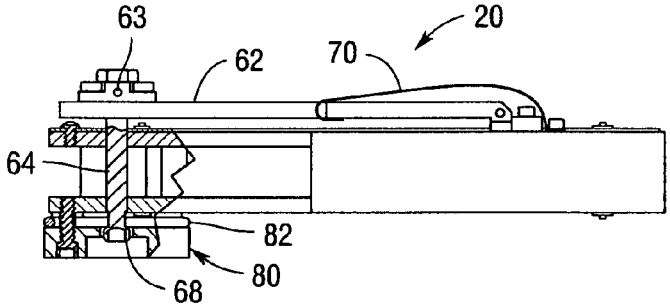
FIG. 4 is a top view showing the loading arm in its ejecting position.
Figure 5:
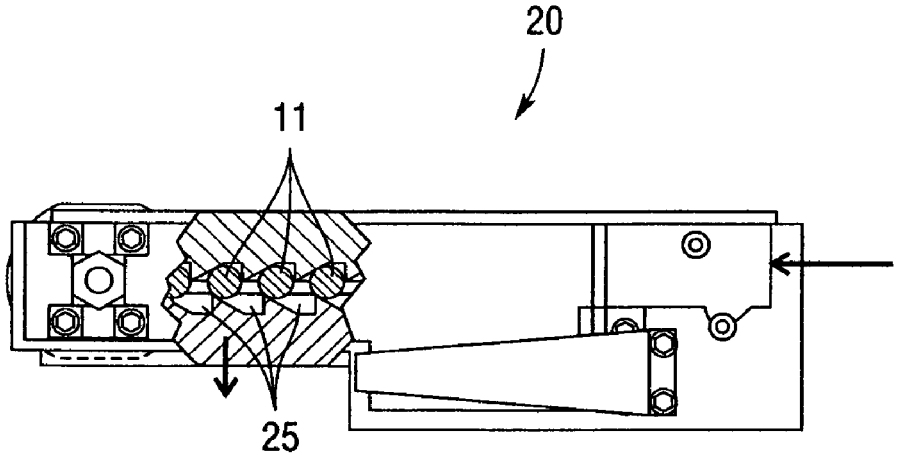
FIG. 5 is a back side view similar to FIG. 2 with the second saw-tooth plate offset relative to the first.
Figure 6:
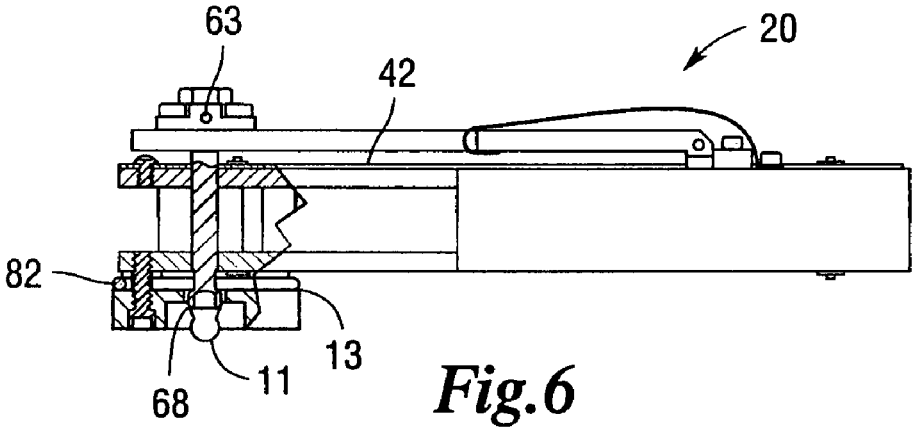
FIG. 6 is a view similar to FIG. 4 showing a pellet being dispensed.
Figure 8:
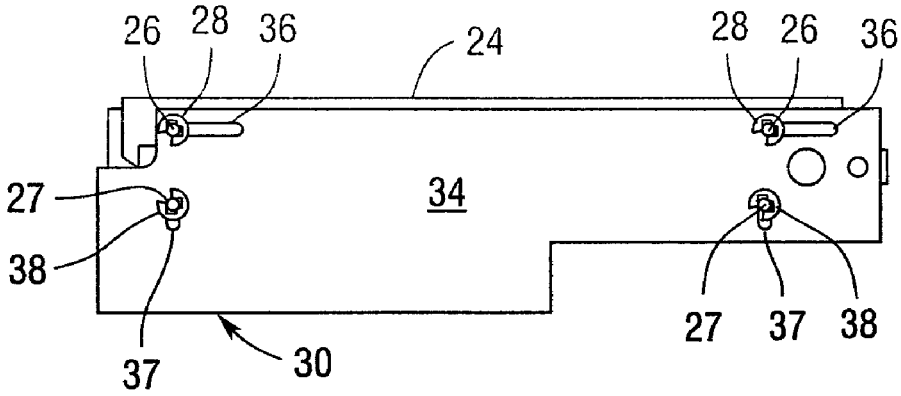
FIG. 8 is a front side view with parts removed to reveal obscured details.

A first embodiment of the pellet loader of the present invention is depicted in FIGS. 1-6 generally at 20. Pellet loader 20 comprises a first sawtooth bar or member 22 positioned adjacent a second sawtooth member 24 which define between them a plurality of seriatim storage chambers 25 (FIG. 5). Each chamber 25 is sized to receive a pellet 11 which is inserted into the tail end 21 of loader 22. Pellets 11 will be loaded into the first storage chamber 25 with the bulbous end extending into the page (FIGS. 2, 5). First and second sawtooth members 22 and 24 are interconnected by first and second side walls 32, 34 which are actually the vertically extending arms of a U-shaped housing 30 (FIG. 3). Second sawtooth member 24 is mounted by pins 26 in slots 36 in sidewalls 32, 34 allowing axial movement in housing 30 (FIG. 8), being secured by circlips 28. First sawtooth member 22 is mounted in U-shaped housing 30 by pins 27 in vertically extending slots 37, secured by circlips 38, permitting first sawtooth member 22 to move vertically. A pair of springs 40 (one shown in FIG. 3) bias first sawtooth member 22 upwardly against second sawtooth member 24.

Figure 7:
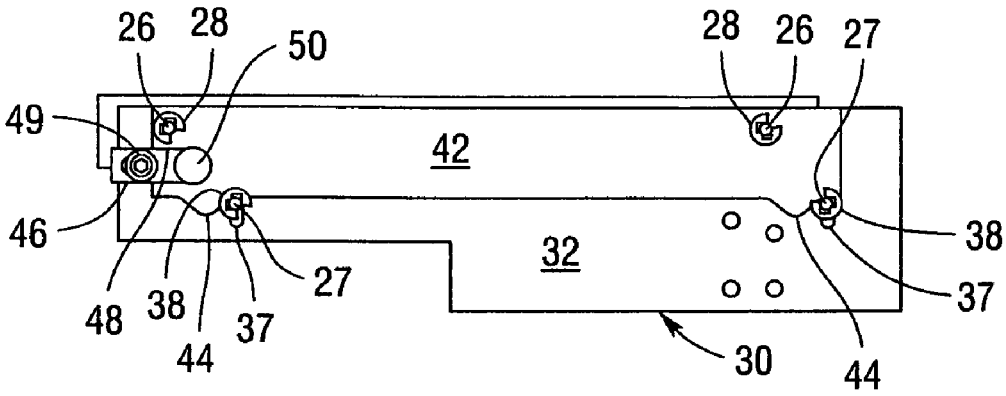
FIG. 7 is a back side view with parts removed.

As seen in FIG. 7, pins 26 attach cam plate 42 to the back side 32 of U-shaped housing 30. A pair of cam lobes 44 engage pins 27 pushing first sawtooth member downwardly as second sawtooth member 24 carrying cam plate 42 moves to-and-fro in housing 30. This downward movement accommodates the width of the pellets 11 (FIG. 5) as they are pushed from one storage chamber 25 to the next. Stop 46 is secured to side wall 32 of housing 30 by threaded fastener 49. L-shaped pivot arm 62 of loading arm assembly 60 is mounted on sidewall 32 of housing 30 by pivot pin 61. Loading arm or plunger 64 is secured to the distal end of pivot arm 62 and leaf spring 70, which is secured to housing 30 by screws 72, engages leg 66 of L-shaped pivot arm 60 biasing it to a retracted position (FIG. 1). When second sawtooth member 24 has been moved from its fully retracted position (FIG. 8) through the intermediate position (FIG. 5) in which first sawtooth member 22 is cammed downwardly, to fully extended position (FIG. 7), pivot arm 62 can be collapsed against the bias of the leaf spring 70 causing the loading arm 64 to eject the pellet 11 which has been moved into its path, through discharge opening 50 which extends through exit chamber 80. Loading arm 64 rotates on axle pin 63 which extends between first and second pillow blocks 63' which are attached to pivot arm 62 by nut/bolt pairs 64'. A spherical portion 68 engages in the skirt end 13 of the pellet 11. Stop 46 is received in a slot 48 in the end of cam plate 42 to ensure spherical portion 68 is retained in discharge opening 50 which extends through both side walls 32, 34 of housing 30. An O-ring 82 is stretched laterally creating an elongated, narrow passageway that has a width less than that of the pellet 11. As the pellet 11 is ejected through the O-ring 82, the lead end 15 of pellet 11 engages the front end of the firing chamber of an air rifle (not shown). As the pellet is squeezed between the front end of the chamber and spherical portion 68 of loading arm 64, spherical portion 68 expands skirt end 13 to ensure superior engagement with the interior surface of the barrel, enhancing pressure behind the pellet 11 and helping to ensure a consistent exit velocity.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A device for loading pellets in an air rifle, said device comprising:

a) a series of separate, distinct storage chambers aligned longitudinally seriatim, each storage chamber fully enclosing an individual pellet and preventing its undesired longitudinal movement, said series of storage chambers including a proximal storage chamber and a distal storage chamber, wherein said series of storage chambers is defined by a first sawtooth bar and a second sawtooth bar positioned adjacent said first sawtooth bar;

b) advancing means for moving the pellet from one separate, distinct storage chamber in said series of chambers to an adjacent one in said series of separate, distinct storage chambers;

c) a loading chamber adjacent said distal storage chamber for receiving the pellet therefrom;

d) a loading arm for engaging the pellet in said loading chamber and transferring said pellet laterally through an exit chamber from which the pellet is loaded into the air rifle.

2. The device of claim 1 wherein said first sawtooth bar is interconnected to said second sawtooth bar by a first and a second side plate.

3. The device of claim 2 further comprising mounting means between said first and said second side plate and said first and second sawtooth bars, said mounting means permitting said first and second sawtooth members to laterally displace one from another while said first and second sawtooth members translate longitudinally relative to each other.

4. The device of claim 3 wherein said advancing means is comprised of said second sawtooth bar translating relative to said first sawtooth member carrying at least one pellet from a first storage chamber to an adjacent storage chamber.

5. The device of claim 3 wherein said first and second side plates are arms of a U-shaped housing surrounding said first and second sawtooth members.

6. The device of claim 5 further comprising spring means positioned in a bottom portion of said U-shaped housing engaging a lower side of said first sawtooth member and biasing it upwardly.

7. The device of claim 6 further comprising cam means to cause said first and second sawtooth members to separate as said second sawtooth member translates relative to said first sawtooth member to permit passage of the at least one pellet.

8. The device of claim 7 wherein said cam means engages a laterally extending can follower positioned in a vertically extending slot, said cam follower being attached to said first sawtooth member, whereby engagement of said cam follower by said cam means forces said first sawtooth member downwardly against said spring means.

9. The device of claim 1 further comprising an O-ring positioned at a juncture between said loading chamber and said exit chamber, said O-ring having an internal dimension smaller than a maximum external dimension of the pellet, retarding an egress of said pellet through said O-ring.

10. The device of claim 9 wherein said loader comprises an ejection rod having an engagement end with a spherical portion, said spherical portion engaging within an open end of the pellet and broadening a skirt formed on the open end as said engagement end pushes the pellet into a breach portion of an air rifle.

* * * * *